US006339153B1

(12) United States Patent
Rivers et al.

(10) Patent No.: US 6,339,153 B1
(45) **Date of Patent: *Jan. 15, 2002**

(54) METHOD OF MAKING REDUCED WATER CONTENT BISOXAZOLIDINE HYDROGEN SULFIDE SCAVENGERS

(75) Inventors: Gordon T. Rivers; James Hackerott, both of Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 10 days.

This patent is subject to a terminal disclaimer.

(21) Appl. No.: 09/632,726

(22) Filed: Aug. 4, 2000

Related U.S. Application Data

(62) Division of application No. 08/970,669, filed on Nov. 14, 1997, now Pat. No. 6,117,310, which is a continuation of application No. 08/679,040, filed on Jul. 12, 1996, now abandoned.

(51) Int. Cl.[7] ..... C07D 273/01; C07D 413/06
(52) U.S. Cl. ..... 544/72; 548/215
(58) Field of Search ..... 544/72; 548/215

(56) References Cited

U.S. PATENT DOCUMENTS

| | | | | |
|---|---|---|---|---|
| 2,647,118 A | | 7/1953 | Hartough et al. | 260/246 |
| 4,166,122 A | | 8/1979 | Paulus et al. | 424/272 |
| 4,978,512 A | | 12/1990 | Dillon | 423/226 |
| 5,128,049 A | | 7/1992 | Gatlin | 210/752 |
| 5,347,003 A | | 9/1994 | Trauffer et al. | 544/8 |
| 5,354,453 A | | 10/1994 | Bhatia | 208/236 |
| 5,488,103 A | | 1/1996 | Gatlin | 536/55.2 |
| 6,117,310 A | * | 7/2000 | Rivers | 208/236 |

FOREIGN PATENT DOCUMENTS

GB 2 290 542 A 1/1996

* cited by examiner

*Primary Examiner*—Deborah C. Lambkin
*Assistant Examiner*—Andrea M. D'Souza
(74) *Attorney, Agent, or Firm*—Paula D. Morris & Associates P.C.

(57) ABSTRACT

A method making sulfhydryl scavenging agents with reduced water content comprising treating the sulfhydryl scavenging agent to remove water. The sulfyhydryl scavenging agent preferably comprises an —N—C—N— moiety produced by condensation of an alkanolamine with an aldehyde. Preferred sulfhydryl scavenging agents are bisoxazolidines.

56 Claims, 7 Drawing Sheets

| NAME | BOTTLE NUMBER | DOSAGE (ppm) | TIME DISP (Hours) | H2S (ppm) | EFFECT RATIO | % H2S VARIANCE |
|---|---|---|---|---|---|---|
| BLANK | A-0 | 0 | 20.25 | 4,233 | NA | -6.0% |
| BLANK | A-0 | 0 | 25.00 | 4,471 | NA | -0.7% |
| BLANK | A-0 | 0 | 39.75 | 4,720 | NA | 4.9% |
| BLANK | A-0 | 0 | 44.50 | 5,180 | NA | 15.1% |
| BLANK | A-0 | 0 | 48.50 | 4,583 | NA | 1.8% |
| BLANK | A-0 | 0 | 65.25 | 3,822 | NA | -15.1% |
| | | | AVERAGE | 4,502 | | |

| NAME | BOTTLE NUMBER | DOSAGE (ppm) | TIME DISP (Hours) | H2S (ppm) | EFFECT RATIO | % H2S ABATED |
|---|---|---|---|---|---|---|
| A | A-1 | 0 | 20.25 | 6,083 | | |
| A | A-1 | 150 | 25.00 | 8,237 | -14.36 | -35.4% |
| A | A-1 | 150 | 39.75 | 6,903 | -5.47 | -13.5% |
| A | A-1 | 250 | 44.50 | 5,400 | 2.73 | 11.2% |
| A | A-1 | 350 | 48.00 | 2,457 | 10.36 | 59.6% |
| A | A-1 | 350 | 65.25 | 2,243 | 10.97 | 63.1% |
| | | | | | | |
| B | A-2 | 0 | 20.25 | 5,414 | | |
| B | A-2 | 150 | 25.00 | 7,321 | -12.71 | -35.2% |
| B | A-2 | 150 | 39.75 | 5,392 | 0.15 | 0.4% |
| B | A-2 | 250 | 44.50 | 4,564 | 3.40 | 15.7% |
| B | A-2 | 350 | 48.50 | 2,854 | 7.31 | 47.3% |
| B | A-2 | 350 | 65.25 | 1,656 | 10.74 | 69.4% |
| | | | | | | |
| RE-3019 | A-3 | 0 | 20.25 | 8,620 | | |
| RE-3019 | A-3 | 150 | 25.00 | 8,095 | 3.50 | 6.1% |
| RE-3019 | A-3 | 150 | 39.75 | 3,531 | 33.93 | 59.0% |
| RE-3019 | A-3 | 250 | 44.50 | 2,369 | 25.00 | 72.5% |
| RE-3019 | A-3 | 350 | 48.50 | 896 | 22.07 | 89.6% |
| RE-3019 | A-3 | 350 | 65.25 | 371 | 23.57 | 95.7% |

FIG. 1A

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-4 | 0 | 20.25 | 7,818 | | |
| RE-3175 | A-4 | 150 | 25.00 | 3,859 | 26.39 | 50.6% |
| RE-3175 | A-4 | 150 | 39.75 | 2,498 | 35.47 | 68.0% |
| RE-3175 | A-4 | 250 | 44.50 | 1,885 | 23.73 | 75.9% |
| RE-3175 | A-4 | 350 | 48.50 | 1,157 | 19.03 | 85.2% |
| RE-3175 | A-4 | 350 | 65.25 | 783 | 20.10 | 90.0% |
| | | | | | | |
| A | A-5 | 0 | 20.25 | 9,166 | | |
| A | A-5 | 150 | 25.00 | 10,497 | -8.87 | -14.5% |
| A | A-5 | 150 | 39.75 | 9,208 | -0.28 | -0.5% |
| A | A-5 | 250 | 44.50 | 8,258 | 3.63 | 9.9% |
| A | A-5 | 350 | 48.50 | 5,890 | 9.36 | 35.7% |
| A | A-5 | 350 | 65.25 | 4,453 | 13.47 | 51.4% |
| | | | | | | |
| B | A-6 | 0 | 20.25 | 8,504 | | |
| B | A-6 | 150 | 25.00 | 9,015 | -3.41 | -6.0% |
| B | A-6 | 150 | 39.75 | 7,628 | 5.84 | 10.3% |
| B | A-6 | 250 | 44.50 | 6,239 | 9.06 | 26.6% |
| B | A-6 | 350 | 48.50 | 4,269 | 12.10 | 49.8% |
| B | A-6 | 350 | 65.25 | 2,867 | 16.11 | 66.3% |
| | | | | | | |
| RE-3019 | A-7 | 0 | 20.25 | 7,988 | | |
| RE-3019 | A-7 | 150 | 25.00 | 7,786 | 1.35 | 2.5% |
| RE-3019 | A-7 | 150 | 39.75 | 3,538 | 29.67 | 55.7% |
| RE-3019 | A-7 | 250 | 44.50 | 2,129 | 23.44 | 73.3% |
| RE-3019 | A-7 | 350 | 48.50 | 770 | 20.62 | 90.4% |
| RE-3019 | A-7 | 350 | 65.25 | 398 | 21.69 | 95.0% |

FIG. 1B

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-8 | 0 | 20.25 | 8,612 | | |
| RE-3175 | A-8 | 150 | 25.00 | 6,340 | 15.15 | 25.4% |
| RE-3175 | A-8 | 150 | 39.75 | 2,847 | 38.43 | 66.9% |
| RE-3175 | A-8 | 250 | 44.50 | 1,787 | 27.30 | 79.2% |
| RE-3175 | A-8 | 350 | 48.50 | 514 | 23.14 | 94.0% |
| RE-3175 | A-8 | 350 | 65.25 | 594 | 22.91 | 93.1% |
| | | | | | | |
| BLANK | A-9 | 0 | 20.25 | 7,100 | NA | -7.6% |
| BLANK | A-9 | 0 | 25.00 | 8,189 | NA | 6.5% |
| BLANK | A-9 | 0 | 39.75 | 7,559 | NA | -1.7% |
| BLANK | A-9 | 0 | 44.50 | 7,516 | NA | -2.2% |
| BLANK | A-9 | 0 | 48.50 | 7,577 | NA | -1.4% |
| BLANK | A-9 | 0 | 65.25 | 8,180 | NA | 6.4% |
| | | | AVERAGE | 7,687 | | |
| | | | | | | |
| BLANK | A-10 | 0 | 20.25 | 10,876 | | |
| BLANK | A-10 | 0 | 25.00 | 12,163 | NA | -11.8% |
| BLANK | A-10 | 0 | 39.75 | 10,203 | NA | 6.2% |
| RE-3019 | A-10 | 169 | 44.50 | 6,340 | 26.84 | 41.7% |
| RE-3019 | A-10 | 350 | 48.50 | 1,510 | 26.76 | 86.1% |
| RE-3019 | A-10 | 350 | 65.25 | 247 | 30.37 | 97.7% |

| ADDITIVE NAME | FINAL COST* $/MB | EFFECT RATIO (T.E.R.) | INITIAL H2S (ppm) | FINAL H2S (ppm) | ADDITIVE STD COST $/LB | ADDITIVE DENSITY gm/ml |
|---|---|---|---|---|---|---|
| A | 18.04 | 10.97 | 6083 | 2243 | 0.4634 | 1.2200 |
| B | 46.08 | 10.74 | 5414 | 1656 | 1.2734 | 1.1100 |
| RE-3019 | 19.47 | 23.57 | 8620 | 371 | 1.1300 | 1.1600 |
| RE-3175 | 22.35 | 20.10 | 7818 | 783 | 0.9650 | 1.3300 |
| A | 14.70 | 13.47 | 9166 | 4453 | 0.4634 | 1.2200 |
| B | 30.72 | 16.11 | 8504 | 2867 | 1.2734 | 1.1100 |
| RE-3019 | 21.16 | 21.69 | 7988 | 398 | 1.1300 | 1.1600 |
| RE-3175 | 19.61 | 22.91 | 8612 | 594 | 0.9650 | 1.3300 |
| RE-3019 | 15.11 | 30.37 | 10876 | 247 | 1.1300 | 1.1600 |

FIG. 1C

| NAME | BOTTLE NUMBER | DOSAGE (ppm) | TIME DISP (Hours) | H2S (ppm) | EFFECT RATIO | % H2S VARIANCE |
|---|---|---|---|---|---|---|
| BLANK | A-0 | 0 | 24.50 | 17,539 | NA | -14.6% |
| BLANK | A-0 | 0 | 27.25 | 23,026 | NA | 12.1% |
| BLANK | A-0 | 0 | 44.75 | 22,257 | NA | 8.4% |
| BLANK | A-0 | 0 | 50.83 | 22,016 | NA | 7.2% |
| BLANK | A-0 | 0 | 69.25 | 21,710 | NA | 5.7% |
| BLANK | A-0 | 0 | 74.42 | 21,251 | NA | 3.5% |
| BLANK | A-0 | 0 | 147.42 | 15,990 | NA | -22.2% |
| | | | AVERAGE | 20,541 | | |

| NAME | BOTTLE NUMBER | DOSAGE (ppm) | TIME DISP (Hours) | H2S (ppm) | EFFECT RATIO | % H2S ABATED |
|---|---|---|---|---|---|---|
| A | A-1 | 0 | 24.50 | 29,339 | | |
| A | A-1 | 250 | 27.25 | 27,732 | 6.43 | 5.5% |
| A | A-1 | 250 | 44.75 | 27,394 | 7.78 | 6.6% |
| A | A-1 | 400 | 50.83 | 25,016 | 10.81 | 14.7% |
| A | A-1 | 400 | 69.25 | 26,061 | 8.20 | 11.2% |
| A | A-1 | 600 | 74.42 | 22,398 | 11.57 | 23.7% |
| A | A-1 | 600 | 147.42 | 24,498 | 8.07 | 16.5 |
| | | | | | | |
| B | A-2 | 0 | 24.50 | 36,936 | | |
| B | A-2 | 250 | 27.25 | 38,692 | -7.02 | -4.8% |
| B | A-2 | 250 | 44.75 | 29,378 | 30.23 | 20.5% |
| B | A-2 | 400 | 50.83 | 25,972 | 27.41 | 29.7% |
| B | A-2 | 400 | 69.25 | 20,992 | 39.86 | 43.2% |
| B | A-2 | 600 | 74.42 | 18,230 | 31.18 | 50.6% |
| B | A-2 | 600 | 147.42 | 15,157 | 36.30 | 59.0% |
| | | | | | | |
| RE-3019 | A-3 | 0 | 24.50 | 30,579 | | |
| RE-3019 | A-3 | 250 | 27.25 | 28,326 | 9.01 | 7.4% |
| RE-3019 | A-3 | 250 | 44.75 | 16,788 | 55.16 | 45.1% |
| RE-3019 | A-3 | 400 | 50.83 | 11,571 | 47.52 | 62.2% |
| RE-3019 | A-3 | 400 | 69.25 | 7,521 | 57.65 | 75.4% |
| RE-3019 | A-3 | 600 | 74.42 | 5,511 | 41.78 | 82.0% |
| RE-3019 | A-3 | 600 | 147.42 | 3,344 | 45.39 | 89.1% |

FIG. 3A

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-4 | 0 | 24.50 | 23,399 | | |
| RE-3175 | A-4 | 250 | 27.25 | 22,314 | 4.34 | 4.6% |
| RE-3175 | A-4 | 250 | 44.75 | 14,029 | 37.48 | 40.0% |
| RE-3175 | A-4 | 400 | 50.83 | 12,410 | 27.47 | 47.0% |
| RE-3175 | A-4 | 400 | 69.25 | 11,015 | 30.96 | 52.9% |
| RE-3175 | A-4 | 600 | 74.42 | 8,807 | 24.32 | 62.4% |
| RE-3175 | A-4 | 600 | 147.42 | 8,903 | 24.16 | 62.0% |
| | | | | | | |
| A | A-5 | 0 | 24.50 | 29,567 | | |
| A | A-5 | 250 | 27.25 | 31,324 | -7.03 | -5.9% |
| A | A-5 | 250 | 44.75 | 28,591 | 3.90 | 3.3% |
| A | A-5 | 400 | 50.83 | 27,055 | 6.28 | 8.5% |
| A | A-5 | 400 | 69.25 | 27,621 | 4.87 | 6.6% |
| A | A-5 | 600 | 74.42 | 22,475 | 11.82 | 24.0% |
| A | A-5 | 600 | 147.42 | 24,199 | 8.95 | 18.2% |
| | | | | | | |
| B | A-6 | 0 | 24.50 | 33,206 | | |
| B | A-6 | 250 | 27.25 | 31,889 | 5.27 | 4.0% |
| B | A-6 | 250 | 44.75 | 20,747 | 49.84 | 37.5% |
| B | A-6 | 400 | 50.83 | 19,338 | 34.67 | 41.8% |
| B | A-6 | 400 | 69.25 | 15,756 | 43.63 | 52.6% |
| B | A-6 | 600 | 74.42 | 11,983 | 35.37 | 63.9% |
| B | A-6 | 600 | 147.42 | 11,370 | 36.39 | 65.8% |
| | | | | | | |
| RE-3019 | A-7 | 0 | 24.50 | 32,899 | | |
| RE-3019 | A-7 | 250 | 27.25 | 26,098 | 27.20 | 20.7% |
| RE-3019 | A-7 | 250 | 44.75 | 13,391 | 78.03 | 59.3% |
| RE-3019 | A-7 | 400 | 50.83 | 9,399 | 58.75 | 71.4% |
| RE-3019 | A-7 | 400 | 69.25 | 6,606 | 65.73 | 79.9% |
| RE-3019 | A-7 | 600 | 74.42 | 3,460 | 49.07 | 89.5% |
| RE-3019 | A-7 | 600 | 147.42 | 2,549 | 50.58 | 92.3% |

FIG. 3B

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-8 | 0 | 24.50 | 33,183 | | |
| RE-3175 | A-8 | 250 | 27.25 | 24,049 | 36.54 | 27.5% |
| RE-3175 | A-8 | 250 | 44.75 | 10,856 | 89.31 | 67.3% |
| RE-3175 | A-8 | 400 | 50.83 | 9,507 | 59.19 | 71.3% |
| RE-3175 | A-8 | 400 | 69.25 | 8,719 | 61.16 | 73.7% |
| RE-3175 | A-8 | 600 | 74.42 | 6,485 | 44.50 | 80.5% |
| RE-3175 | A-8 | 600 | 147.42 | 5,213 | 46.62 | 84.3% |
| | | | | | | |
| BLANK | A-9 | 0 | 24.50 | 33,645 | NA | -3.3% |
| BLANK | A-9 | 0 | 27.25 | 37,220 | NA | 7.0% |
| BLANK | A-9 | 0 | 44.75 | 36,630 | NA | 5.3% |
| BLANK | A-9 | 0 | 50.83 | 35,516 | NA | 2.1% |
| BLANK | A-9 | 0 | 69.25 | 36,865 | NA | 6.0% |
| BLANK | A-9 | 0 | 74.42 | 33,541 | NA | -3.6% |
| BLANK | A-9 | 0 | 147.42 | 30,069 | NA | -13.6% |
| | | | AVERAGE | 34,784 | | |
| | | | | | | |
| BLANK | A-10 | 0 | 24.50 | 34,609 | | |
| BLANK | A-10 | 0 | 27.25 | 37,104 | NA | -7.2% |
| BLANK | A-10 | 0 | 44.75 | 36,438 | NA | -5.3% |
| A | A-10 | 400 | 50.83 | 29,426 | 12.96 | 15.0% |
| A | A-10 | 400 | 69.25 | 27,315 | 18.24 | 21.1% |
| A | A-10 | 600 | 74.42 | 23,390 | 18.70 | 32.4% |
| A | A-10 | 600 | 147.42 | 27,895 | 11.19 | 19.4% |

| | | TYPICAL TREATMENT COSTS | | | | |
|---|---|---|---|---|---|---|
| ADDITIVE NAME | FINAL COST* $/MB | EFFECT RATIO (T.E.R.) | INITIAL H2S (ppm) | FINAL H2S (ppm) | ADDITIVE STD COST $/LB | ADDITIVE DENSITY gm/ml |
| A | 20.42 | 8.07 | 29339 | 24498 | 0.4534 | 1.0380 |
| B | 11.93 | 36.30 | 36936 | 15157 | 1.2602 | 0.9820 |
| RE-3019 | 9.40 | 45.39 | 30579 | 3344 | 1.1310 | 1.0780 |
| RE-3175 | 13.48 | 24.16 | 23399 | 8903 | 0.8270 | 1.1250 |
| A | 18.82 | 8.95 | 29567 | 24199 | 0.4634 | 1.0380 |
| B | 11.90 | 36.39 | 33206 | 11370 | 1.2602 | 0.9820 |
| RE-3019 | 8.44 | 50.58 | 32899 | 2549 | 1.1310 | 1.0780 |
| RE-3175 | 6.99 | 46.62 | 33183 | 5213 | 0.8270 | 1.1250 |
| A | 14.72 | 11.19 | 34609 | 27895 | 0.4534 | 1.0380 |

FIG. 3C

METHOD OF MAKING REDUCED WATER CONTENT BISOXAZOLIDINE HYDROGEN SULFIDE SCAVENGERS

This application is a divisional of Ser. No. 08/970,669 Nov. 14, 1997 now U.S. Pat No. 6,117,310, which is a continuation of Ser. No. 08/679,040 Jul. 12, 1996 abandoned.

FIELD OF THE INVENTION

The invention relates to methods for making sulfhydryl scavenging agents having a reduced water content. Preferred are methods for making reduced water content condensation products, more preferably reduced water content bisoxazolidines.

BACKGROUND OF THE INVENTION

The removal of $H_2S$ from a liquid or gaseous hydrocarbon stream is a problem that has challenged many workers in many industries. One such industry is the petroleum industry, where the $H_2S$ content of certain crudes from reservoirs in many areas of the world is too high for commercial acceptance. The same is true of many natural gas streams. Hydrogen sulfide has an offensive odor, and streams containing $H_2S$ often are called "sour" streams. Treatments to reduce or remove $H_2S$ from hydrocarbon or other substrates often are called "sweetening" treatments. Even where a crude or gas stream contains only a minor amount of sulfur, the processes to which the crude oil or fractions thereof are subjected often produce one or more hydrocarbon streams that contain $H_2S$.

The presence of $H_2S$ in hydrocarbon streams presents many environmental and safety hazards. Hydrogen sulfide is highly flammable, toxic when inhaled, and strongly irritates the eyes and other mucous membranes. In addition, sulfur-containing salts can deposit in and plug or corrode transmission pipes, valves, regulators, and the like. Flaring of natural gas that contains $H_2S$ does not solve the problem for gas streams because, unless the $H_2S$ is removed prior to flaring, the combustion products will contain unacceptable amounts of pollutants, such as sulfur dioxide ($SO_2$)—a component of "acid rain."

The problem of removing or reducing $H_2S$ from hydrocarbon substrates has been solved in many different ways in the past. A number of known systems treat a hydrocarbon stream with an amine, an aldehyde, an alcohol, and/or a reaction product of these agents. One such product is the product from the condensation reaction of an alkanolamine and an aldehyde.

Unfortunately, water is a natural by-product of a condensation reaction. The condensation product of an alkanolamine and an aldehyde comprises a mole of water for every "N—C—N" moiety produced. For example, bisoxazolidine produced by a condensation reaction comprises approximately 20 wt % water. It is unsafe to add a sulfhydryl scavenger comprising about 20 wt % water to a substantially water free refinery stream which is at a high temperature and under pressure.

The water content of a given sulfhydryl scavenging agent that creates a danger, and the level of the danger created, varies with the temperature and the pressure of the substrate. A danger clearly exists where a refinery stream is at a temperature of about 400° F. or higher and a pressure of about 50 psig. If an alkanolamine/aldehyde condensation product comprising about 20 wt % water, or even less, were added to a refinery stream at such high temperature and high pressure, the water in the condensation product would rapidly vaporize and cause "steam hammering." Steam hammering has been known to damage refinery equipment and has the potential to cause catastrophic rupture and release of the refinery stream into the environment. Methods of making condensation products with much lower water content are needed in order to avoid this problem.

Methods also are needed to increase the efficiency of such scavengers. For example, previously known sulfhydryl scavengers theoretically require the use of about 2–3 ppm of scavenger per ppm of hydrogen sulfide; however, the amount actually required is much higher—in the range of about 5–10 ppm or more per ppm of hydrogen sulfide. The inefficiency is believed to result from inadequate solubility of the scavenger in the substrate, which makes it difficult to distribute the scavenger evenly throughout the substrate.

A continuing need exists for methods of making efficient sulfhydryl scavenging agents having a water content sufficiently low to avoid steam hammering.

SUMMARY OF THE INVENTION

The present invention provides a method comprising providing a sulfhydryl scavenging agent comprising an initial water content, and treating the sulfhydryl scavenging agent to reduce the initial water content, producing a dry sulfhydryl scavenging agent having a reduced water content.

BRIEF DESCRIPTION OF THE DRAWINGS

FIG. 1 is a Table giving the results of Example 2.

FIG. 3 is a Table giving the results of Example 3.

DETAILED DESCRIPTION OF THE INVENTION

Figure 2:
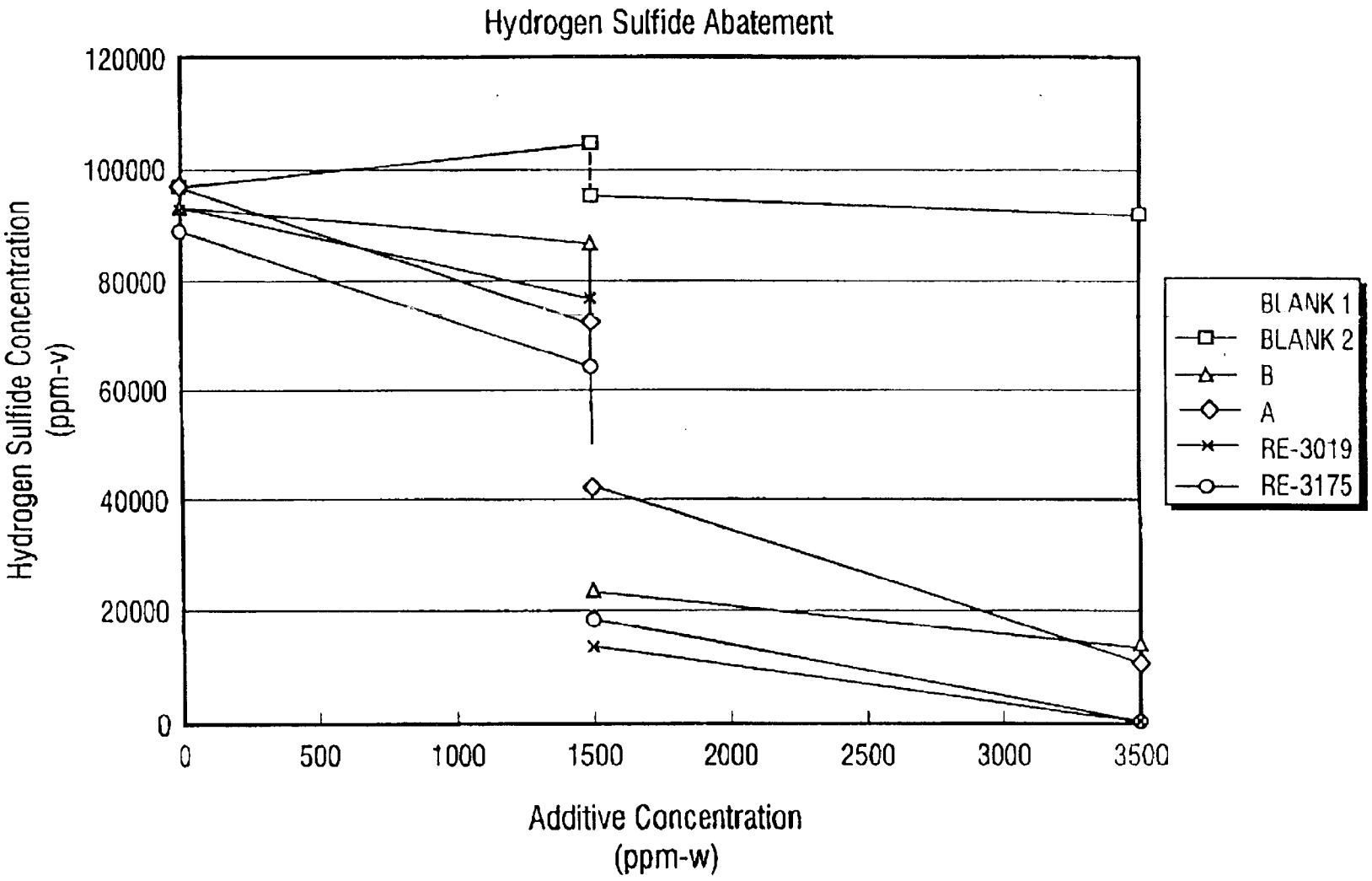
FIG. 2 is a chart of the results in FIG. 1.

As used herein, the phrase "sulfhydryl scavenging agent" is defined to refer to an agent that is useful to treat hydrocarbon substrates that are rendered "sour" by the presence of "sulfhydryl compounds," such as hydrogen sulfide ($H_2S$), organosulfur compounds having a sulfhydryl (—SH) group, known as mercaptans, also known as thiols (R—SH, where R is a hydrocarbon group), thiol carboxylic acids (RCO—SH), dithio acids (RCS—SH), and related compounds.

A wide variety of hydrocarbon substrates can be treated using the scavenging agents of the present invention. The term "hydrocarbon substrate" is meant to include unrefined and refined hydrocarbon products, including natural gas, derived from petroleum or from the liquefaction of coal, both of which contain hydrogen sulfide or other sulfur-containing compounds. Particularly for petroleum-based substrates, the term "hydrocarbon substrate" includes wellhead condensate as well as crude oil, which may be contained in storage facilities at the producing field. "Hydrocarbon substrate" also includes the same materials transported from those facilities by barges, pipelines, tankers, or trucks to refinery storage tanks, or, alternately, transported directly from the producing facilities through pipelines to the refinery storage tanks. The term "hydrocarbon substrate" also includes product streams found in a refinery, including distillates such as gasolines, distillate fuels, oils, and residual fuels. As used in the claims, the term "hydrocarbon substrate" also refers to vapors produced by the foregoing materials.

Preferred substrates for the sulfhydryl scavenging agents of the present invention are those in which the presence of water can be detrimental. Such substrates include, but are not necessarily limited to dry crude oils and fuels, such as natural gas, particularly dry natural gas condensates. Although the sulfhydryl scavenging agents may be used to treat substantially any hydrocarbon substrate, preferred substrates comprise less than 20 wt % water, preferably about 15 wt % water or less, more preferably about 10 wt % water or less, and most preferably about 5 wt % water or less.

The sulfhydryl scavenging agents of the present invention may be any sulfhydryl scavenging agent that contains water, preferably as a byproduct of its formation. Preferred sulfhydryl scavenging agents comprise products of condensation reactions. More preferred sulfhydryl scavenging agents comprise condensation products of an alkanolamine and an aldehyde. Most preferred sulfhydryl scavenging agents are bisoxazolidines having the following general formula:

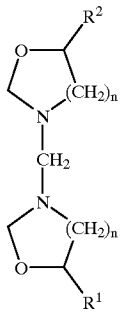

wherein n is from about 1 to about 2 and $R^1$ and $R^2$ independently are selected from the group consisting of hydrogen, phenyl groups and linear, branched, and cyclic alkyl groups, alkenyl groups, and alkynyl groups comprising from about 1 to about 6 carbon atoms. In a preferred embodiment, n is 1 and $R^1$ and $R^2$ independently are selected from the group consisting of phenyl groups and linear, branched, and cyclic alkyl groups, alkenyl groups, and alkynyl groups comprising from about 1 to about 3 carbon atoms. A most preferred embodiment is 3,3'methylenebis-[5-methyl oxazolidine], in which n is 1 and $R^1$ and $R^2$ are methyl groups.

While specific examples of $R^1$ and $R^2$ have been described, any "soluble bisoxazolidine" is suitable for use in the invention. As used herein, the phrase "soluble bisoxazolidines" is defined to refer to bisoxazolidines in which $R^1$ and $R^2$ are substituents that do not substantially interfere with the solubility of the bisoxazolidine in the hydrocarbon substrate. Soluble bisoxazolidines include, but are not necessarily limited to products of the reaction of 1, 2 or 1, 3 amino alcohols containing from about 3 to about 7 carbon atoms with aldehydes containing 4 or fewer carbon atoms. A substituent "substantially interferes" with the solubility of the bisoxazolidine if the bisoxazolidine cannot be rendered readily soluble in the substrate with the use of an acceptable cosolvent. In this regard, when $R^1$ and $R^2$ are hydrogen, a cosolvent may be required to maintain the solubility of the bisoxazolidine. A preferred cosolvent in such instance comprises a combination of from about out 10 to about 50% BUTYLCELLOSOLVE™, a monobutylether of ethylene glycol available from Union Carbide, and from about 50 to about 90% FINASOL™, available from Fina Oil & Chemical Co., Dallas, Tex.

The bisoxazolidines of the present invention exhibit a high uptake capacity for hydrogen sulfide, and the raw materials required to manufacture the bisoxazolidines are low cost materials. Bisoxazolidines are commercially available in Europe as preservatives for oil base paints and fuel oils. An example of such a product is GROAN-OX™, which is commercially available from Sterling Industrial, UK. Bisoxazolidines are made by reacting an alkanolamine, with between about 1.1 to 2.1 equivalents, preferably 1.5 equivalents, of paraformaldehyde to yield an aqueous solution of reaction products. In a preferred embodiment, monoisopropanolamine (MIPA) is reacted with paraformaldehyde to form an aqueous mixture which (after distillation) yields substantially water free 3,3'-methylenebis[5-methyloxazolidine]. In this preferred embodiment, the reaction takes place at ambient pressure and at a temperature of between about 100–200° C. (212–392° F.).

Any suitable method for removing water from the sulfhydryl scavenging agent may be used, including but not necessarily limited to simple distillation at atmospheric pressure, distillation under pressure, distillation under vacuum, azeotropic distillation with a solvent such as toluene, xylene, or cyclohexane, or removal of water with a drying agent such as silica, alumina, molecular sieves, or a salt such as anhydrous magnesium sulfate. A preferred method to remove the water is distillation, most preferably vacuum distillation. In order to remove water by vacuum distillation, the sulfhydryl scavenging agent containing the water preferably is placed in a vacuum oven at 100° C. By vacuum pump, the pressure in the oven is reduced to about 30 inches of vacuum, resulting in water removal by vacuum distillation. Regardless of the technique used to remove water, the water in the scavenging agent is reduced to about 15 wt %, preferably about 5 wt % or less, even more preferably about 2 wt % or less. The water content may be measured using any suitable means, including but not necessarily limited to Karl Fisher titration, or near infrared spectroscopy.

Where the scavenging agent is bisoxazolidine, the water content most preferably is reduced to the point at which a spike in the bisoxazolidine content occurs. A "spike" is defined as a rise in bisoxazolidine content to about 50 area % or more. A spike in bisoxazolidine content can be the result of a variety of factors, a most important factor being water content. Preferably, the water in the bisoxazolidine is removed to about 2 wt. % or less. Thereafter, depending upon the use for the particular bisoxazolidine, the water content may be increased to a desired level, preferably to about 15 wt. % or less, more preferably about 10 wt. % or less, and even more preferably about 5 wt. % or less, or to a water content at which the spike in bisoxazolidine disappears. The area percent bisoxazolidine may be monitored using suitable methods, such as carbon-13 NMR spectra with an external deuterium oxide NMR lock signal. The methyl signal near 20d in the carbon spectrum is compared to the effective area of the compound as a percentage of the total carbon area.

The product resulting after the water content is reduced to a desired level is herein called the "dry" sulfhydryl scavenging agent. As used herein, the term "dry sulfhydryl scavenging agent" refers to a sulfhydryl scavenging agent that has been treated to contain less than about 20 wt % water, more preferably about 15 wt % water or less, even more preferably about 5 wt % water or less, and most preferably about 2 wt % water or less.

The water content of a given sulfhydryl scavenging agent that will be "tolerated" by a given substrate, or that will not cause steam hammering, will vary according to amount of water in the substrate, the temperature, and the pressure of the substrate. The water content of the sulfhydryl scavenging agent preferably is proportional to the water content of the substrate. A sulfhydryl scavenging agent containing about 5 wt % water or less is tolerated by most substrates even at high temperature and pressure.

The bisoxazolidine preferably should be added to the hydrocarbon substrate at a high enough temperature that the substrate is flowable for ease in mixing. The treatment may take place at temperatures up to the temperature at which the material being treated begins to decompose. Preferred treatment temperatures are from ambient to about 200° C. (392° F.).

The substrate is treated with the dry sulfhydryl scavenging agent, preferably dry bisoxazolidine, until reaction with hydrogen sulfide, or with other sulfhydryl compounds, has produced a product in which the sulfhydryls in the vapor (or liquid) phase have been removed to an acceptable or specification grade product. Typically, the sulfhydryls in the vapor phase must be reduced to at least about 200 ppm or less.

Persons of ordinary skill in the art will understand how to determine the amount of a given sulfhydryl scavenging agent needed to treat a given substrate. For example, in order to determine how much bisoxazolidine to add to a given substrate, the amount of $H_2S$ in the vapor phase above the hydrocarbon is measured. The bisoxazolidine is added to the hydrocarbon in an amount equal to about 2/3–1 ppm by weight of scavenger per 10 ppm by volume of $H_2S$ concentration in the vapor phase. Alternately, the total concentration of hydrogen sulfide in the system can be measured, and a molar ratio of between about 1/3–2/3 mole of bisoxazolidine to 1 mole of hydrogen sulfide in the system may be added. The molar amount of bisoxazolidine added as a scavenger is proportional to the molar amount of sulfhydryl compound(s) present in the substrate and depends upon the level of sulfhydryl reduction required. Hydrogen sulfide contents of up to about 100,000 ppm in the vapor phase may be treated satisfactorily with bisoxazolidines. Bisoxazolidines are most effective if the substrate is treated at temperatures of from ambient to about 200° C. (392° F.).

The invention will be better understood with reference to the following examples:

EXAMPLE 1

In a liter flask was placed 600 gm of monoisopropanolamine (MIPA). The MIPA was stirred and cooled in a water bath. In about three equal portions, 400 gm of paraformaldehyde was added. During the first two additions, the pot temperature reached a maximum of about 95° C. (203° F.). The second and third portions of paraformaldehyde were added after the mixture had cooled to about 65° C. (149° F.). After the third portion of paraformaldehyde was added, the mixture was warmed and kept at 95° C. (203° F.) until all of the paraformaldehyde had dissolved. The mixture was gradually warmed to 140° C. (284° F.) and about 242 gm of distillate were collected. The material remaining in the flask was determined to be essentially pure 3,3'-methylenebis-[5-methyloxazolidine].

EXAMPLE 2

The following basic protocol was used for each of Examples 2–3:

Septum bottles were half filled with hydrogen sulfide laden marine or No. 6 fuel oil from a Louisiana refinery. The head spaces were blanketed with nitrogen. The bottles were septum sealed and placed in an oven at 65° C. (149° F.). After 18 hours, samples were shaken and the head spaces were analyzed for hydrogen sulfide by withdrawing a known volume from the head space with a gas-tight syringe. The sample (or a dilution of the sample in air) was injected into a gas chromatograph (GC) and the area counts of hydrogen sulfide measured. The results were noted as the initial vapor phase hydrogen sulfide concentration for comparison to final readings. A known amount of the candidate and comparative materials were injected into all of the sample bottles except controls. The control bottles were designated blanks (i.e., untreated). The bottles were shaken vigorously for 30 seconds to mix the additives into the oil, and placed in an oven at 65.5° C. (150° F.). The bottles were shaken periodically, and samples of the head space vapor were withdrawn using a gas tight $\mu$L syringe at various intervals. The samples were analyzed by gas chromatography. If the measured amount of vapor phase hydrogen sulfide was not significantly abated, the process was repeated after additional incremental injections of candidate.

The hydrogen sulfide content of the head space in the samples and the control were calculated by comparing the area counts with a standard curve for hydrogen sulfide. The results are shown in the respective Figures.

The efficacy of the candidate may be expressed as the treatment effectiveness ratio ("TER"). The TER is defined as $$\frac{PPM_v \text{ of vapor } H_2S \text{ abated}}{PPM_w \text{ of candidate added}}$$

The higher the value of "T.E.R.," the greater the efficacy.

For purposes of this experiment, several products commercially available for the same purpose (designated "A" and "B") were compared with samples internally designated "RE-3019" and "RE-3175," which contain 3,3'-methylene bis-[5-methyl oxazolidine] and a mixture of reaction products, a major proportion of which comprises 3,3'-methylene bisoxazolidine, respectively. The objective was to produce a series of dosage response curves for the additives.

The oil was dosed to a level of 18,000 ppm $H_2S$ and dispensed into the serum bottles. The bottles were allowed to equilibrate for approximately 2 days. Initial vapor space hydrogen sulfide concentrations in the serum bottles averaged between 92,000–100,000 ppm-v. The results are given in FIG. 1, and charted in FIG. 2.

FIG. 1 shows the results for the additives two hours after the first injection of 1500 ppm-w of candidate. The samples were allowed additional reaction time overnight. The vertical drop line in FIG. 1 shows the additional amount of hydrogen sulfide abated after 16.5 hours at 1500 ppm-w of each additive. Finally, FIG. 1 displays the results 3.5 hours following the second dosage injection totaling 3500 ppm-w of each additive. The two experimental additives, RE-3019 and RE-3175, reduced hydrogen sulfide to nearly zero. For chart clarity, the test results for the replicate run of RE-3175 were not included. The replicate results mirrored the results for the original RE-3175 sample.

EXAMPLE 3

The commercial candidates again were compared with RE-3019 and RE-3175. The commercial candidates were tested in their "as sold" concentrations; RE-3019 was tested as a 100% concentrate; and, RE-3179 was tested as 80% active gel dispersed in xylene. The reaction times for all of the samples was slower than expected, but uniformly so for an undetermined reason.

The results are given in FIG. 3. Both RE-3019 and RE-3179 had a very high TER—from about 8 to 5 times higher than commercial candidates.

EXAMPLE 4

The initial water content of RE-3019 was determined. Several 4 oz. bottles each containing 25 grams of RE-3019 were placed in a vacuum oven at 100° C. By vacuum pump, the pressure in the oven was reduced to about 30 inches of vacuum. Thus in this case, water was removed from the samples by vacuum distillation. Over time, samples were taken from the oven. The water content was determined by Karl Fisher titration on a Brinkman/Sybron or Aquatest 2010 autotitrator. The percent bisoxazolidine was estimated by carbon-13 NMR. The spectra were acquired on undiluted samples with deuterium oxide as an external NMR lock signal. Bisoxazolidine was measured using the methyl signal near 20d in the carbon spectrum, and comparing the effective area of the compound as a percentage of the total carbon area. Some margin of error is inherent in this technique because the methyl group is nearly, but not completely, resolved from the methyl signal of other isomers. % $NCH_2OR$ was calculated as the area percent of peaks from about 80–90d in the carbon spectra.

The following results were recorded:

| Sample | % Water | % Water | average | Area % Bisoxazolidine | Area % $NCH_2OR$ |
|---|---|---|---|---|---|
| 0 | 15.59, 15.39 | 15.5 | 15.5 | 36 | 15.6 |
| 1 | 13.84, 14.47 | 14.2 | 14.2 | 34 | 16.8 |
| 2 | 11.65, 11.68 | 11.7 | 11.7 | 39 | 16.2 |
| 3 | 9.24, 9.78, 9.37 | 9.5 | 9.5 | 40 | 16.6 |
| 4 | 8.78, 9.83 | 9.3 | 9.3 | 36 | 16.6 |
| 5 | 6.15, 6.65 | 6.4 | 6.4 | 39 | 15.9 |
| 6 | 1.26, 1.26 | 1.3 | 1.3 | 66 | 18.8 |

Although the water content was progressively reduced in samples 1–5, a significant increase in area percent bisoxazolidine was not seen until sample 6, where the water content was reduced to less than 5%.

EXAMPLE 5

Aliquots of sample 6 from Example 4 containing 2% water or less??—IS THIS RIGHT were diluted to obtain a range of samples containing a variety of water contents from 2 to 6.4 weight percent.

The following results were observed:

| Sample | % Water | Area % Bisoxazolidine |
|---|---|---|
| A | 6.4 | 55 |
| B | 5.0 | 54 |
| C | 4.0 | 54 |
| D | 3.0 | 56 |
| E | 2.0 | 57 |

From the foregoing, it appears that the area percent bisoxazolidine spiked and remained substantially constant in all of the samples to which water was added.

Persons of ordinary skill in the art will appreciate that many modifications may be made to the embodiments described herein without departing from the spirit of the present invention. Accordingly, the embodiments described herein are illustrative only and are not intended to limit the scope of the present invention.

What is claimed is:

1. A method of producing a dry sulfhydryl scavenging agent having a reduced water content comprising:

providing a sulfhydryl scavenging agent comprising an initial water content; and, treating said sulfhydryl scavenging agent to reduce said initial water content, producing a dry sulfhydryl scavenging agent having a reduced water content.

2. A method of producing a dry sulfhydryl scavenging agent having a reduced water content comprising:

providing a sulfhydryl scavenging agent comprising an initial water content; and, removing water from said sulfhydryl scavenging agent by distillation to reduce said initial water content, producing a dry sulfhydryl scavenging agent having a reduced water content.

3. A method of producing a dry sulfhydryl scavenging agent having a reduced water content comprising:

providing a sulfhydryl scavenging agent comprising an initial water content; and, treating said sulfhydryl scavenging agent to reduce said initial water content, producing a dry sulfhydryl scavenging agent having a reduced water content of about 15 wt. % or less.

4. A method of producing a dry sulfhydryl scavenging agent having a reduced water content comprising:

providing a sulfhydryl scavenging agent comprising an initial water content; and, treating said sulfhydryl scavenging agent to reduce said initial water content, producing a dry sulfhydryl scavenging agent having a reduced water content of about 5 wt. % or less.

5. A method of producing a dry sulfhydryl scavenging agent having a reduced water content comprising:

providing a sulfhydryl scavenging agent comprising a product of a condensation reaction, said product comprising an initial water content; and, treating said sulfhydryl scavenging agent to reduce said initial water content, producing a dry sulfhydryl scavenging agent having a reduced water content.

6. A method of producing a dry sulfhydryl scavenging agent having a reduced water content comprising:

providing a sulfhydryl scavenging agent comprising a product of a condensation reaction, said product comprising an initial water content; and, removing water from said sulfhydryl scavenging agent by distillation to reduce said initial water content, producing a dry sulfhydryl scavenging agent having a reduced water content.

7. A method of producing a dry sulfhydryl scavenging agent having a reduced water content comprising:

providing a sulfhydryl scavenging agent comprising a product of a condensation reaction, said product comprising an initial water content; and, treating said sulfhydryl scavenging agent to reduce said initial water content, producing a dry sulfhydryl scavenging agent having a reduced water content of about 15 wt. % or less.

8. The method of claim 6 wherein said reduced water content is about 5 wt. % or less.

9. A method of producing a dry sulfhydryl scavenging agent having a reduced water content comprising:

reacting at least one amino alcohol with al least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content.

10. A method of producing a dry sulfhydryl scavenging agent having a reduced water content comprising:

reacting at least one amino alcohol with at least one aldehyde to form a condensation product comprising an initial water content and at least one compound comprising an N—C—N moiety;

removing water from said condensation product by distillation to reduce said initial water content, producing a dry sulfhydryl scavenging agent having a reduced water content.

11. A of producing a dry sulfhydryl scavenging agent having a reduced water content comprising:

reacting at least one amino alcohol with at least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content of about 15 wt. % or less.

12. The method of claim 9 wherein said reduced water content is about 5 wt. % or less.

13. A method of producing a dry sulfhydryl scavenging agent having a reduced water content comprising:

reacting at least one amino alcohol with at least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content, said dry sulfhydryl scavenging agent comprising about 50 area % of said compound or more.

14. A method of producing a dry sulfhydryl scavenging agent having a reduced water content comprising:

reacting at least one amino alcohol with at least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content, said dry sulfhydryl scavenging agent comprising about 50 area % of said compound or more.

15. A method of producing a dry sulfhydryl scavenging agent having a reduced water content comprising:

reacting at least one amino alcohol with at least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content, said dry sulfhydryl scavenging agent comprising about 50 area % of said compound or more.

16. A method of producing a dry sulfhydryl scavenging agent having a reduced water content comprising:

reacting at least one amino alcohol with at least one aldehyde to form a condensation product comprising an initial water content and at least one compound comprising an N—C—N moiety;

treating a sulfhydryl scavenging agent comprising said condensation product to reduce said initial water content, producing a dry sulfhydryl scavenging agent having a reduced water content, said dry sulfhydryl scavenging agent comprising about 50 area % of said compound or more.

17. The method of claim 9 wherein said aldehyde comprises in the range of from about 1 to about 4 carbon atoms.

18. The method of claim 10 wherein said aldehyde comprises in the range of from about 1 to about 4 carbon atoms.

19. The method of claim 11 wherein said aldehyde comprises in the range of from about 1 to about 4 carbon atoms.

20. The method of claim 12 wherein said aldehyde comprises in the range of from about 1 to about 4 carbon atoms.

21. The method of claim 15 wherein said aldehyde comprises in the range of from about 1 to about 4 carbon atoms.

22. The method of claim 16 wherein said aldehyde comprises in the range of from about 1 to about 4 carbon atoms.

23. The method of claim 9 wherein said amino alcohol comprises in the range of from about 3 to about 7 carbon atoms and is selected from the group consisting of a 1,2-amino alcohol and a 1,3-amino alcohol.

24. The method of claim 10 wherein said amino alcohol comprises in the range of from about 3 to 7 about carbon atoms and is selected from the group consisting of a 1,2-amino alcohol and a 1,3-amino alcohol.

25. The method of claim 11 wherein said amino alcohol comprises in the range of from about 3 to about 7 carbon atoms and is selected from the group consisting of a 1,2-amino alcohol and a 1,3-amino alcohol.

26. The method of claim 12 wherein said amino alcohol comprises in the range of from about 3 to about 7 carbon atoms and is selected from the group consisting of a 1,2-amino alcohol and a 1,3-amino alcohol.

27. The method of claim 15 wherein said amino alcohol comprises in the range of from about 3 to about 7 carbon atoms and is selected from the group consisting of a 1,2-amino alcohol and a 1,3-amino alcohol.

28. The method of claim 16 wherein said amino alcohol comprises in the range of from about 3 to about 7 carbon atoms and is selected from the group consisting of a 1,2-amino alcohol and a 1,3-amino alcohol.

29. A method of producing a dry sulfhydryl scavenging agent having a reduced water content comprising:

reacting an alkanolamine with a paraformaldehyde, producing a condensation product comprising an initial water content and a compound having the following general structure:

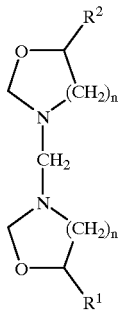

wherein n is from about 1 to about 2;

$R^1$ and $R^2$ independently are selected from the group consisting of hydrogen, phenyl groups, and linear, branches, or cyclic alkyl groups, alkenyl groups, and alkynyl groups comprising from about 1 to about 6 carbon atoms;

treating a sulfhydryl scavenging agent comprising said condensation product to reduce said initial water content, producing a dry sulfhydryl scavenging agent having a reduced water content.

30. A method of producing a dry sulfhydryl scavenging agent having a reduced water content comprising:

reacting at least one alkanolamine with at least one paraformaldehyde to form at least one condensation product comprising an initial water content and a compound having the following general structure:

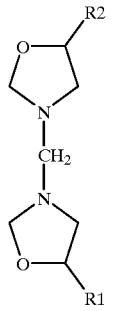

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry scavenging agent having a reduced water content.

31. The method of claim 29 wherein said treating said sulfhydryl scavenging agent comprises removing water from said sulfhydryl scavenging agent by distillation.

32. The method of claim 30 wherein said treating said sulfhydryl scavenging agent comprises removing water from said sulfhydryl scavenging agent by distillation.

33. The method of claim 1 wherein said sulfhydryl scavenging agent comprises a soluble bisoxazolidine.

34. The method of claim 5 wherein said product comprises a soluble bisoxazolidine.

35. The method of claim 29 wherein said linear, branched, and cyclic alkyl groups, alkenyl groups, and alkynyl groups comprise from about 1 to about 3 carbon atoms.

36. The method of claim 30 wherein said linear, branched, and cyclic alkyl groups, alkenyl groups, and alkynyl groups comprise from about 1 to about 3 carbon atoms.

37. The method of claim 31 wherein said linear, branched, and cyclic alkyl groups, alkenyl groups, and alkynyl groups comprise from about 1 to about 3 carbon atoms.

38. The method of claim 32 wherein said linear, branched, and cyclic alkyl groups, alkenyl groups, and alkynyl groups comprise from about 1 to about 3 carbon atoms.

39. The method of claim 29 wherein $R^1$ and $R^2$ are methyl groups.

40. The method of claim 30 wherein $R^1$ and $R^2$ are methyl groups.

41. The method of claim 31 wherein $R^1$ and $R^2$ are methyl groups.

42. The method of claim 32 wherein $R^1$ and $R^2$ are methyl groups.

43. The method of claim 35 wherein $R^1$ and $R^2$ are methyl groups.

44. The method of claim 36 wherein $R^1$ and $R^2$ are methyl groups.

45. The method of claim 37 wherein $R^1$ and $R^2$ are methyl groups.

46. The method of claim 38 wherein $R^1$ and $R^2$ are methyl groups.

47. A method of producing a dry sulfhydryl scavenging agent having a reduced water content comprising:

reacting an alkanolamine with a paraformaldehyde, producing a condensation product comprising an initial water content and a compound having the following general structure:

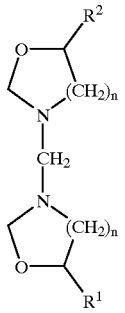

wherein n is from about 1 to about 2;

$R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry sulfhydryl scavenging agent having a reduced water content of about 15 wt. % or less.

48. A method of producing a dry sulfhydryl scavenging agent having a reduced water content comprising:

reacting an alkanolamine with a paraformaldehyde, producing a condensation product comprising an initial water content and a compound having the following general structure:

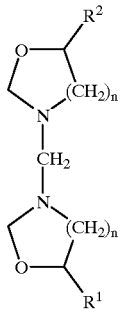

wherein n is from about 1 to about 2;

$R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry sulfhydryl scavenging agent having a reduced water content of about 5 wt. % or less.

49. A method of producing a dry sulfhydryl scavenging agent having a reduced water content comprising:

reacting at least one alkanolamine with at least one paraformaldehyde to form at least one condensation product comprising an initial water content and a compound having the following general structure:

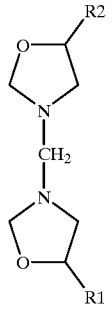

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry scavenging agent having a reduced water content, wherein said reduced water content is about 15 wt. % or less.

50. A method of producing a dry sulfhydryl scavenging agent having a reduced water content comprising:

reacting at least one alkaolamine with at least one paraformaldehyde to form at least one condensation product comprising an initial water content and a compound having the following general structure:

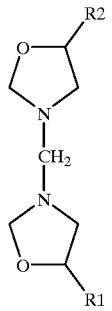

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry scavenging agent having a reduced water content of about 5 wt. % or less.

51. A method of producing a dry sulfhydryl scavenging agent having a reduced water content comprising:

reacting at least one alkanolamine with at least one paraformaldehyde to form at least one soluble bisoxazolidine comprising an initial water content and a compound having the following general structure:

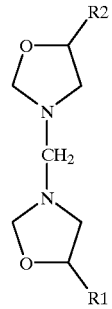

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said soluble bisoxazolidine to reduce said initial water content, producing a dry scavenging agent having a reduced water content comprising at least about 50 area % of said compound.

52. A method of producing a dry sulfhydryl scavenging agent having a reduced water content comprising:

reacting at least one alkanolamine with at least one paraformaldehyde to form at least one condensation product comprising an initial water content and a compound having the following general structure:

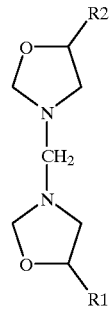

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry scavenging agent having a reduced water content, said dry scavenging agent comprising:

providing a soluble bisoxazolidine comprising an initial water content; and, treating said soluble bisoxazolidine to reduce said initial water content, producing a modified soluble bisoxazolidine having a reduced water content, said modified soluble bisoxazolidine comprising at least about 50 area % of said soluble bisoxazolidine.

53. A method of producing a dry sulfhydryl scavenging agent having a reduced water content comprising:

reacting an alkanolamine with a paraformaldehyde, producing a condensation product comprising an initial water content and a compound having the following general structure:

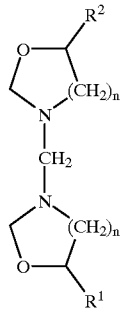

wherein n is from about 1 to about 2;

$R^1$ and $R^2$ independently are selected from the group consisting of hydrogen, phenyl groups, and linear, branched, of cyclic alkyl groups, alkenyl groups, and alkynyl groups comprising from about 1 to about 6 carbon atoms;

treating a sulfhydryl scavenging agent comprising said condensation product to reduce said initial water content, producing a dry sulfhydryl scavenging agent having a reduced water content, said dry sulfhydryl scavenging agent comprising at least about 50 area % of said compound.

54. A method of producing a dry sulfhydryl scavenging agent having a reduced water content comprising:

reacting at least one alkanolamine with at least one paraformaldehyde to form at least one condensation product comprising an initial water content and a compound having the following general structure:

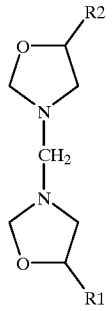

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

treating a sulfhydryl scavenging agent comprising said condensation product to reduce said initial water content, producing a dry scavenging agent having a reduced water content, said dry scavenging agent comprising at least about 50 area % of said compound.

55. A method of producing a dry sulfhydryl scavenging agent having a reduced water content comprising:

reacting an alkanolamine with a paraformaldehyde, producing a condensation product comprising an initial water content and a compound having the following general structure:

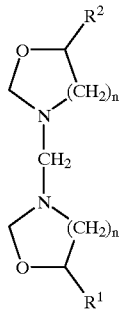

wherein n is from about 1 to about 2;

$R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

removing water from said sulfhydryl scavenging agent by distillation, thereby reducing said initial water content, producing a dry sulfhydryl scavenging agent having a reduced water content, said dry sulfhydryl scavenging agent comprising at least about 50 area % of said compound.

56. A method of producing a dry sulfhydryl scavenging agent having a reduced water content comprising:

reacting at least one alkanolamine with at least one paraformaldehyde to form at least one condensation product comprising an initial water content and a compound having the following general structure:

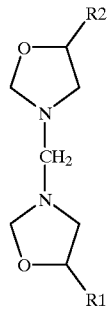

wherein $R^1$ and $R^2$ independently are selected from the group consisting of hydrogen, phenyl groups, and linear, branched, or cyclic alkyl groups, alkenyl groups, and alkynyl groups comprising from about 1 to about 6 carbon atoms;

removing water from said sulfhydryl scavenging agent by distillation, thereby reducing said initial water content, producing a dry scavenging agent having a reduced water content, said dry scavenging agent comprising at least about 50 area % of said compound.

* * * * *

UNITED STATES PATENT AND TRADEMARK OFFICE

CERTIFICATE OF CORRECTION

PATENT NO. : 6,339,153 B1
DATED : January 15, 2002
INVENTOR(S) : Rivers et al.

It is certified that error appears in the above-identified patent and that said Letters Patent is hereby corrected as shown below:

Drawings,
Figure 1C, please delete column titled "FINAL COST* $/MB".
Figure 1C, please delete column titled "ADDITIVE STD COST $/LB".
Figure 3C, please delete column titled "FINAL COST* $/MB".
Figure 3C, please delete column titled "ADDITIVE STD COST $/LB".

Column 4,
Line 51, delete "20d" and substitue -- 20δ --.

Column 7,
Line 20, delete "80-90d" and substitute -- 80-90δ --.
Line 48, delete "?? - IS THIS RIGHT were".

Signed and Sealed this

Twenty-third Day of March, 2004

JON W. DUDAS
*Acting Director of the United States Patent and Trademark Office*